US008598478B2

(12) United States Patent
Buss

(10) Patent No.: US 8,598,478 B2
(45) Date of Patent: Dec. 3, 2013

(54) SWITCH

(75) Inventor: Wolfgang Buss, Solingen (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 210 days.

(21) Appl. No.: 13/232,933

(22) Filed: Sep. 14, 2011

(65) Prior Publication Data

US 2012/0061214 A1 Mar. 15, 2012

(30) Foreign Application Priority Data

Sep. 15, 2010 (DE) ..... 10 2010 037 551

(51) Int. Cl.
*H01H 3/16* (2006.01)

(52) U.S. Cl.
USPC ..... 200/61.7

(58) Field of Classification Search
USPC ..... 200/61.7, 294, 534, 405, 406, 512, 513, 200/516, 521
See application file for complete search history.

(56) References Cited

U.S. PATENT DOCUMENTS

| | | | | |
|---|---|---|---|---|
| 6,262,381 | B1 * | 7/2001 | Kikuchi et al. | 200/6 A |
| 6,552,287 | B2 * | 4/2003 | Janniere | 200/406 |
| 6,563,068 | B2 * | 5/2003 | Yamagata et al. | 200/406 |
| 2006/0096847 | A1 | 5/2006 | Hishimura | |
| 2009/0266699 | A1 | 10/2009 | Rothkopf | |
| 2010/0032271 | A1 | 2/2010 | Maehara | |

FOREIGN PATENT DOCUMENTS

| | | | |
|---|---|---|---|
| DE | 102007062907 | B3 | 3/2009 |
| EP | 0 538 199 | A2 | 4/1993 |
| EP | 1 750 291 | A1 | 2/2007 |
| WO | WO 2005/020260 | A1 | 3/2005 |

OTHER PUBLICATIONS

International Search Report, mailing date Feb. 27, 2013, for corresponding European Patent No. 2431990.

* cited by examiner

*Primary Examiner* — Edwin A. Leon
(74) *Attorney, Agent, or Firm* — Intellectual Property Law Group LLP

(57) ABSTRACT

The invention relates to a switch for a door, a flap or a door handle of a motor vehicle, having a base body with a receptacle; a first contact area and second contact area, both areas provided in the receptacle; a snap-action plate arranged in the receptacle having a curved region situated above the first contact area, and at least three support elements, with at least one support element contacting the second contact area, the curved region undergoing elastic deformation by operation of the snap-action plate, thereby achieving an electrical connection between the two contact areas and therefore generating a switching signal, with the second contact area, which is at a distance from the first contact area, extending at least in regions around the first contact area such that at least one support element touches the second contact area in every possible position of the snap-action plate within the receptacle.

23 Claims, 4 Drawing Sheets

SWITCH

CROSS-REFERENCE TO RELATED APPLICATIONS

This application claims priority to German application no. DE 10 2010 037 511.9 filed on Sep. 15, 2010, which is hereby incorporated by reference in its entirety.

SEQUENCE LISTING

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION (1) Field of the Invention

The invention relates to a switch for a door, a flap or a door handle of a motor vehicle, having a base body which has a receptacle, a first contact area and a second contact area, which are provided in the receptacle, and a snap-action plate which is arranged in the receptacle, with the two contact areas being electrically connected to one another by means of operation of the snap-action plate, as a result of which a switching signal can be generated.

(2) Background Art

DE 10 2007 062 907 B3 describes a snap-action plate which can be used in a switch. It has disadvantageously been shown that the production of such switches with a snap-action plate can be complex since corresponding adjustment of the snap-action plate to the contact areas of the receptacle is required so that reliable functioning is ensured when the switch is in the assembled state. Specifically, it is necessary to ensure that the snap-action plate is placed in the receptacle in such a way that an electrical connection is always established between the two contact areas, which are arranged within the receptacle, when the snap-action plate is operated.

BRIEF SUMMARY OF THE INVENTION

The object of the present invention is to avoid the above-mentioned disadvantages, in particular to provide a switch which can be produced in a simple and cost-effective manner.

The object of the present invention is achieved by all the features of patent claim 1. Advantageous developments are cited in the dependent claims.

According to the invention, provision is made for the switch to be formed with a base body which has a receptacle. Furthermore, a first contact area and a second contact area are located in the receptacle, with the snap-action plate being arranged in the receptacle. In addition, the snap-action plate has a curved region, which is situated above the first contact area, and at least three support elements, with at least one support element making contact with the second contact area, with the curved region undergoing elastic deformation by means of operation of the snap-action plate, so that an electrical connection between the two contact areas can be achieved and therefore a switching signal can be generated. In this case, it is essential to the invention that the second contact area, which is at a distance from the first contact area, extends at least in regions around the first contact area in such a way that at least one support element touches the second contact area in every position of the snap-action plate. A particular advantage of this invention is that the snap-action plate has to be introduced only into the receptacle of the base body, without it being necessary to orient the snap-action plate within the receptacle depending on the position of said receptacle since the arrangement of the first contact area and of the second contact area according to the invention ensures that the snap-action plate always touches the second contact area at least by way of one support element. Readjustment of the snap-action plate within the receptacle is therefore no longer necessary, as a result of which the complexity of production of a switch can be considerably simplified.

According to the invention, provision can be made for the receptacle to be of circular, oval, square, rectangular or triangular design. The snap-action plate, by way of its support elements, should be adapted depending on the geometrical design of the receptacle.

It may be advantageous for the first contact area to be arranged centrally in the receptacle and/or the second contact area to extend along the edge region of the receptacle. If the switch is operated, the curved region of the snap-action plate undergoes elastic deformation, and therefore contact is made with the first contact area, as a result of which the snap-action plate, which is composed of metal, electrically connects the first contact area and the second contact area to one another. In contrast, the second contact area runs on the edge region of the receptacle and has a defined length, so as to ensure that one of the support elements makes contact with the second contact area in every location and every position of the snap-action plate within the receptacle.

In an advantageous embodiment of the invention, the snap-action plate can have n support elements, with each support element being oriented at an angle $\alpha=(360/n)°$ relative to the adjacent support element. It is therefore feasible for the snap-action plate to have three, four or more support elements, said support elements likewise serving as "contact legs" in this case in order to make contact with the second contact area.

If the receptacle is of circular design, one possible design variant of the invention makes provision for the second contact area to extend on a circular path, with the length L of the second contact area being $L>\mathrm{arc}(\alpha)\times r$, where r is the radius of the circular path. As a result, it is possible to ensure that a support element of the snap-action plate always rests on the second contact area, without complex adjustment of the snap-action plate being necessary during assembly of the switch.

It is likewise feasible for the second contact area to be made up of individual contact areas which are spaced apart from one another. Therefore, a large number of individual contact areas can form the second contact area within the receptacle, said individual contact areas being geometrically arranged in relation to one another in such a way that at least one support element makes contact with one individual contact area in every possible position of the snap-action plate within the receptacle.

In one possible embodiment of the invention, the first contact area and the second contact area can be composed of metal, in particular the first contact area and/or the second contact area can be coated with gold. One advantage of the gold coating is that the corrosion resistance of the contact areas can be significantly increased, as a result of which the service life of the switch can be increased.

In order to further simplify assembly of the switch, the receptacle can have an obliquely running wall region which tapers in the direction of the snap-action plate. In this case, the wall region, which runs obliquely, serves as a mounting aid for the snap-action plate which is to be inserted. In this case, the wall region is formed in a funnel-like manner, with the obliquely running wall region becoming narrower in the direction of the receptacle. During the mounting and the insertion of the snap-action plate, the snap-action plate slips and/or slides along the oblique wall region and approaches the receptacle. The snap-action plate then breaks contact with the oblique wall region and falls onto the second contact area by way of at least one of the support elements.

In one feasible embodiment of the invention, a cover, which is composed of plastic and is attached to the base body, can close the receptacle in a sealing manner, with, in particular, the cover being attached to the base body in an interlocking and/or force-fitting and/or cohesive manner. For example, it is possible to attach the cover to the base body by means of an adhesive connection or a clip connection. The cover can likewise be attached to the base body by laser welding. In a further cost-effective alternative, provision is made for the base body to have latching elements which project into mating latching elements of the cover. The cover can have, for example, one or more openings into which latching elements of the base body project in an interlocking and/or cohesive manner and therefore constitute a reliable and cost-effective alternative for attaching the cover to the base body. As a result, the snap-action plate is reliably covered within the receptacle.

In order to prevent unnecessary movement of the support elements during operation of the switch or of the snap-action plate, during which the curved region undergoes elastic deformation in the direction of the first contact area, the cover has a foot element in one possible embodiment of the invention, said foot element projecting into the receptacle and making contact with the support elements, as a result of which the snap-action plate can be reliably fixed. The foot element therefore reliably holds each of the support elements in its position on the second contact area. There is no risk of the support element losing contact with the second contact area even when the snap-action plate is operated.

The foot element can advantageously run in an encircling manner, in particular the foot element can be of annular design. The foot element can at the same time perform a sealing function for the cover. In the case of a circular receptacle, the foot element has a circular design which projects into the receptacle in the manner of a projection and at the same time makes contact with the support elements.

In a measure which improves the invention, provision can be made for the cover to have a seal which has a first seal region and a second seal region, with the first seal region being a radial seal and the second seal region being an axial seal, with, in particular, the seal being L-shaped in a cross-sectional view of the cover. In this case, the foot element can be a constituent part of the second seal region which acts as an axial seal.

The receptacle can advantageously be surrounded by a collar element of the base body, with the cover resting on the collar element, with, in particular, the seal making contact with the collar element. In this case, the collar element can protrude out of the base body in the manner of a projection, with the collar element bounding the receptacle at the same time. The first seal region and the second seal region can rest against the collar element when the cover is in the attached state. It is likewise feasible for the obliquely running wall region to be arranged on the collar element or even be integrated in the collar element. Furthermore, the collar element can be designed with corresponding latching elements in order to ensure a reliable clip connection to the cover.

In one possible embodiment of the invention, the cover can be a two-component plastic part, with a first region of the plastic part being produced from a first plastic and a second region of the plastic part being produced from a second plastic, with the first plastic being softer than the second plastic. In one possible embodiment of the invention, it is feasible for the first and/or the second seal region to be at least partially formed with the first plastic. It is likewise feasible for the foot element to be formed with the first plastic. Manufacturing tolerances can advantageously be compensated for by virtue of the use of the softer plastic, and therefore reliable attachment of the cover to the receptacle is ensured.

The first region of the cover can advantageously be formed with an internal contact element which extends in the direction of the curved region of the snap-action plate. This provides improved haptic behavior of the switch, it being possible for the internal contact element, which extends in the direction of the snap-action plate in the manner of a projection, to be at a distance from the snap-action plate or to rest on the curved region of the snap-action plate when the switch is not operated. The two last-mentioned design variants of the contact element make it possible, inter alia, to influence the haptic behavior of the switch and to influence the travel of the switch. If the contact element rests on the snap-action plate without the switch being operated, the travel can be considerably reduced, as a result of which the switch can be constructed to be compact overall.

Provision can likewise be made for the second region of the cover to surround the first region of the cover, with the second region of the cover being attached to the base body. The second region of the cover, which is composed of a relatively hard plastic, can be used to actually attach the cover to the base body, it being possible for the second region to also perform the sealing functions at the same time. In contrast, the first, softer region of the cover serves to provide corresponding haptics for the user.

In a further embodiment of the switch according to the invention, the mating latching element of the cover can be formed with a latching hook which is held in the latching element of the base body, with the latching element of the base body being in the form of an opening. In this case, the mating latching element can be integrated in the second region of the cover. The second region of the cover can have a plurality of mating latching elements which are reliably held on the base body by means of a latching connection. In one possible embodiment of the invention, the cover has two latching hooks, with the snap-action plate being located between the two mating latching elements of the cover. One advantage of this embodiment is that the cover can be easily mounted on the base body by means of the latching hooks.

It is likewise feasible for the second region of the cover to have an edge on the lower face of the cover, with the edge having a sealing means which is formed from the first plastic, with, in particular, the first region being integrally connected to the sealing means. Therefore, in addition to a first seal region and a second seal region, the cover can have a further sealing means on the edge of the cover, said sealing means creating an additional sealing effect for the switch.

In addition, the first contact area and the second contact area can respectively be a constituent part of a first contact element and of a second contact element, with the first contact element and the second contact element extending out of the receptacle. The sealing means of the edge of the cover provides reliable sealing of the first contact element and of the second contact element, it being possible for said contact elements to further extend outside the cover. In contrast, the first seal region and the second seal region, which provide radial and axial sealing, serve mainly to ensure that the constituent parts within the receptacle are reliably sealed off.

In order for the cover, which is in the form of a two-component plastic part in one possible embodiment, to represent a stable overall construction, the first region and the second region can have a common contact area which is formed, in particular, in a stepped and/or staircase-like manner. The corresponding geometric design of the contact areas of the first region of the cover and of the second region of the cover additionally has the effect that good haptics are ensured when the first region is operated, without there being a risk of the first region becoming detached from the second region. The stepped and/or staircase-like contact areas therefore likewise make a contribution to reliable connection of the first region to the second region.

BRIEF DESCRIPTION OF THE SEVERAL VIEWS OF THE DRAWINGS

Further advantages, features and details of the invention can be gathered from the following description. Several exemplary embodiments of the invention are described in detail with reference to the drawings. In this case, the features mentioned in the claims and in the description may each be essential to the invention individually in their own right or in any desired combination. In the drawings:

DETAILED DESCRIPTION OF THE INVENTION

Figure 1:
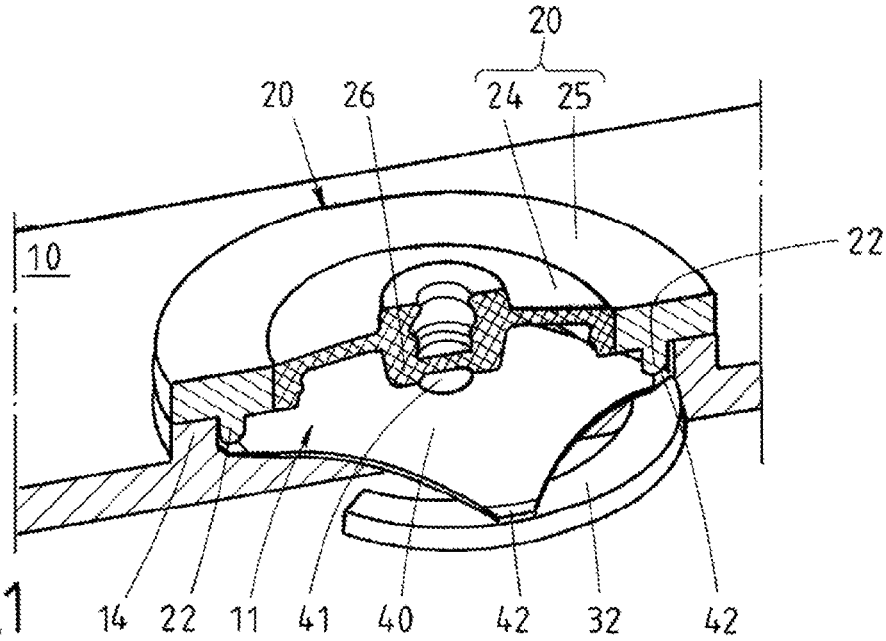
FIG. 1 shows one possible exemplary embodiment of a switch according to the invention with a snap-action plate, a cover and contact areas on which the snap-action plate rests.

All the exemplary embodiments according to FIG. 1 to FIG. 9 show a switch according to the invention which can be used in a door, in a flap or in a door handle of a motor vehicle. The switch has a base body 10 which is designed with a receptacle 11 into which a snap-action plate 40 can be inserted. The receptacle 11 has a first contact area 31 and a second contact area 32, said contact areas being at least partially illustrated in FIG. 1 to FIG. 5. According to the shown exemplary embodiments, the first contact area 31 is arranged centrally in the receptacle 11. In contrast, the second contact area 32 extends along the edge region of the receptacle 11 and is at a defined distance from the first contact area 31. In this case, the receptacle 11 is of circular design. The first contact area 31 is likewise of circular form, with the second contact area 32 extending along a circular path.

According to FIG. 1, FIG. 2, FIG. 4 and FIGS. 7-9, the snap-action plate 40 has a curved region 41 which is situated above the first contact area 31. In addition, the snap-action plate 40 has a plurality of support elements 42, with the snap-action plate 40 and also the second contact area 32 being geometrically matched to one another in such a way that at least one support element 42 makes contact with the second contact area 32. This ensures that reliable functioning of the switch, in the case of which the two contact areas 31, 32 can be electrically connected by means of operation of the snap-action plate 40, is ensured in every feasible installation position of the snap-action plate 40 in the receptacle 11. It is not necessary, during production of the switch, after the snap-action plate 40 has already been inserted into the receptacle 11, to readjust the snap-action plate 40 relative to the second contact area 32 or to rotate it about an axis which runs perpendicular to the plane of the drawing according to FIG. 3 or FIG. 4 and extends through the first contact area 31.

Figure 3:
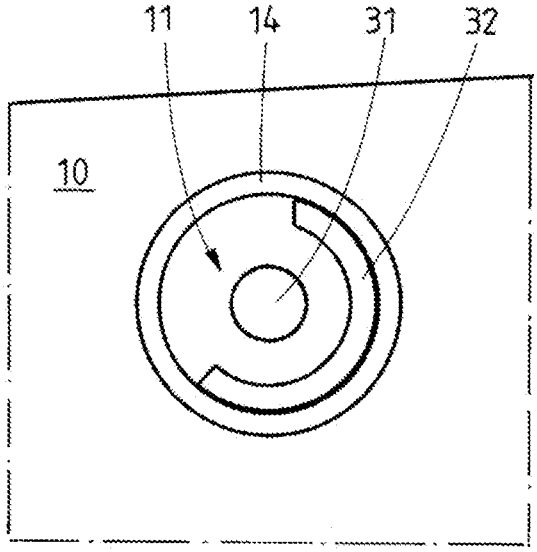
FIG. 3 shows a plan view of a receptacle of the switch, it being possible for the snap-action plate according to FIG. 1 to be inserted into said receptacle.
Figure 4:
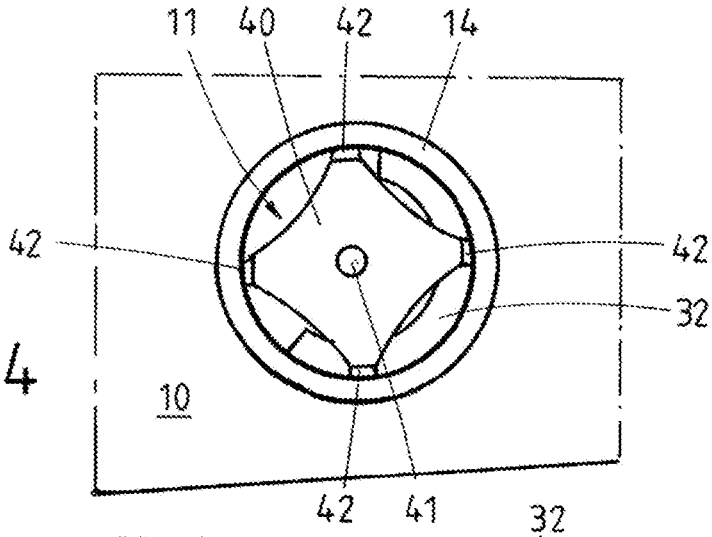
FIG. 4 shows the receptacle according to FIG. 3, with the snap-action plate inserted in said receptacle.

FIG. 3 shows one possible exemplary embodiment of the geometric design of the second contact area 32 which extends along a circular path around the first contact area 31. In addition to this, FIG. 4 shows the snap-action plate 40 which is inserted into the receptacle 11 according to FIG. 3. In this exemplary embodiment, two support elements 42 make contact with the second contact area 32. However, according to the invention, it would be sufficient if the second contact area 32 were only to have a length, in particular an "arc length", in the case of which only one support element 42 would rest on the second contact area 32, this not being explicitly illustrated. This means that the length L of the contact area 32 can be described in accordance with the following equation: $L > \mathrm{arc}(\alpha) \times r$, where r is the radius of the circular path and $\alpha = (360/n)°$, where n is the number of support elements.

Figure 5:
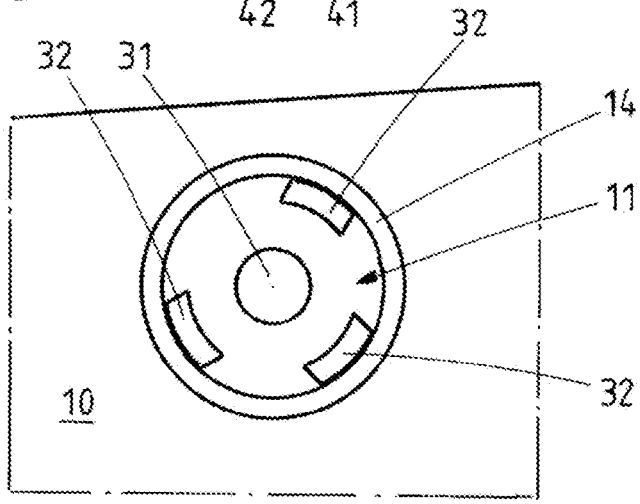
FIG. 5 shows a further alternative embodiment of a receptacle according to FIG. 3.

FIG. 5 shows a further exemplary embodiment in which a second contact area 32 is provided, said second contact area being made up of three individual contact areas 32 which are spaced apart. It goes without saying that it is feasible to vary the number of individual contact areas and also the respective lengths of the individual contact areas 32. It is possible to ensure, as a function of the geometry of the snap-action plate 40 and also the individual contact areas 32, that contact with at least one support element 42 and one individual contact area 32 is always ensured in every location and position of the snap-action plate 40, this not being explicitly illustrated in the figures.

Figure 7:
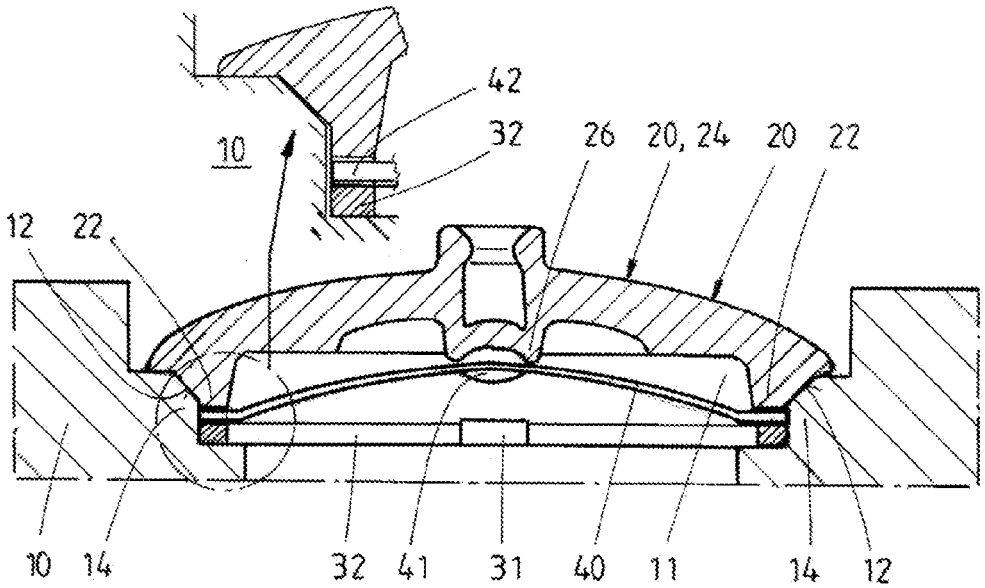
FIG. 7 shows a further exemplary embodiment of a switch with a snap-action plate, contact areas and also a cover.

FIG. 7 schematically shows the receptacle 11 which has an obliquely running wall region 12. The wall region 12 is in the form of a funnel. In this case, the wall region tapers in the direction of the snap-action plate 40 which rests on the second contact area 32 by way of its support elements 42. One advantage of an obliquely running wall region 12 is that the snap-action plate 40 can be simply "thrown" into the receptacle 11 during production of the switch and insertion of the snap-action plate 40, with the wall region 12 at the same time ensuring that the snap-action plate 40 reliably finds its way into the receptacle 11 and onto the contact areas 31, 32. In the process, the snap-action plate 40 slides along the wall region 12 by way of its support elements 42, until the snap-action plate 40 falls into the receptacle 11. The wall region 12 therefore serves as a mounting aid for the snap-action plate 40.

As illustrated in FIGS. 1 and 2 and FIGS. 7-9, the cover 20 has a foot element 22 which projects into the receptacle 11 and makes contact with the support elements 42. This results in the snap-action plate 40 being reliably held in the installed state, without the risk of one or more support elements 42 breaking contact with the second contact area 32 when the switch is operated. In this case, the foot element 22 is formed in an encircling, annular manner.

Figure 2:
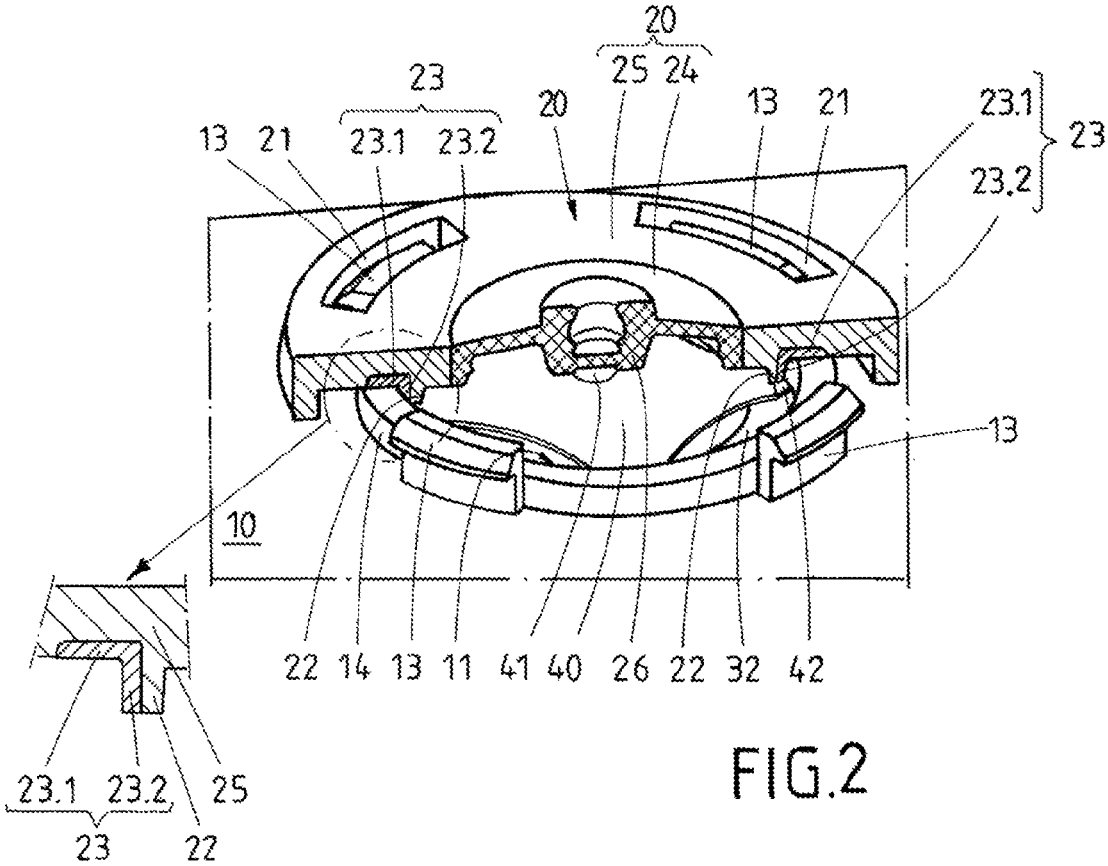
FIG. 2 shows a further exemplary embodiment of a switch with a snap-action plate, contact areas and a cover.

As can be seen in FIG. 1, FIG. 2 and also FIG. 7 in particular, the receptacle 11 is surrounded by a collar element 14 of the base body 10. The collar element 14 constitutes a kind of wall in this case. FIG. 1 illustrates one possible exemplary embodiment for attaching the cover 20 to the base body 10. In this case, the cover 20 is laser-welded to the collar element 14, as a result of which the encapsulated receptacle 11 is reliably sealed off. In a further exemplary embodiment, it is likewise feasible for the cover 20 to be attached to the collar element 14 by means of an adhesive connection.

Figure 6:
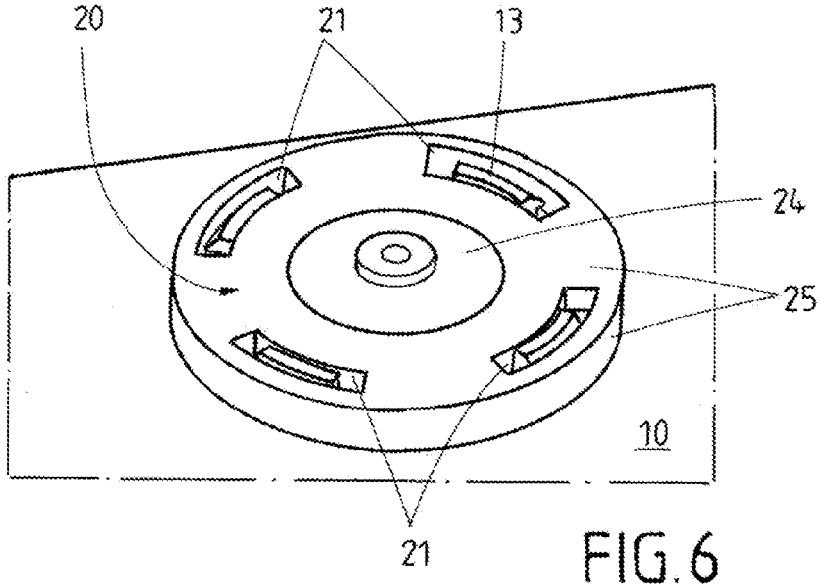
FIG. 6 shows the switch according to FIG. 2 in a further, three-dimensional view.
Figure 8:
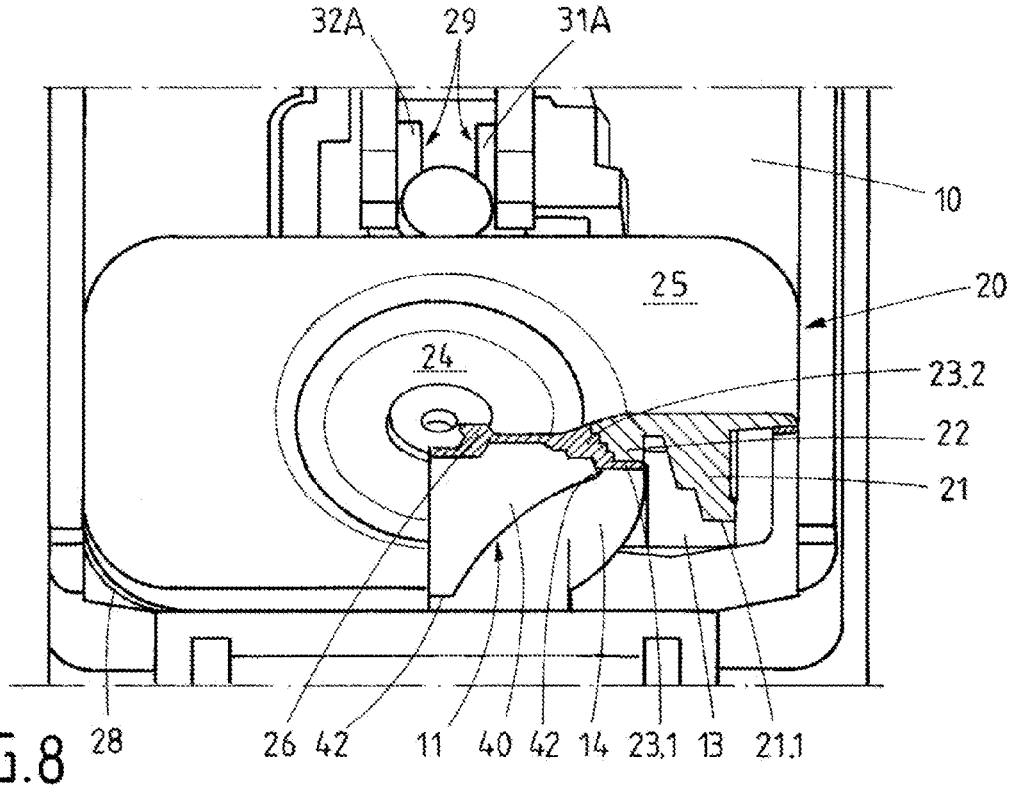
FIG. 8 shows a further exemplary embodiment of a switch with a snap-action plate, contact areas and also a cover.

A further exemplary embodiment for attaching the cover 20 to the base body 10 is illustrated according to FIG. 2, FIG. 6 and also FIGS. 7-8, with the cover 20 being attached to the base body 10 by means of a clip connection. In this case, the base body 10 has hook-like latching elements 13 which engage in mating latching elements 21, in particular openings 21 in the cover 20, and therefore ensure reliable attachment of the cover 20 to the base body 10. In order to ensure reliable sealing of the inner region of the receptacle 11, the cover 20 has a seal 23 which has a first seal region 23.1 and a second seal region 23.2 according to FIG. 2. The seal 23 is of L-shaped design in the cross section of the cover 20. In this case, the cover 20 is a two-component plastic part, with the seal 23 being composed of a first plastic. In this case, the cover 20 has a first region 24 which is arranged centrally on the cover 20. The second region 25 surrounds the first region 24, with the second region 25 of the cover 20 being harder than the first region 24. In addition, the first region 24 of the cover is formed with an internal contact element 26 which extends in the direction of the curved region 41 of the snap-action plate 40. In the following exemplary embodiment, the first region 24 of the cover 20 is produced from the same first plastic as the seal 23.

Figure 9:
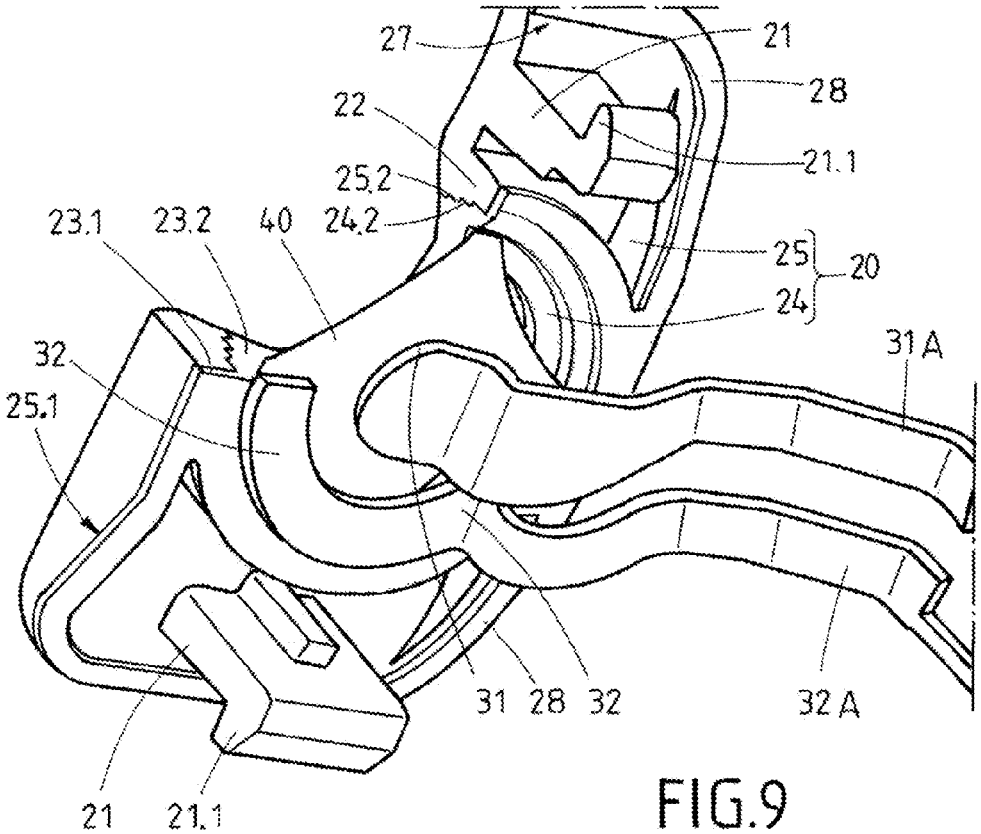
FIG. 9 shows a further view of the switch according to FIG. 8.

FIGS. 8 and 9 show a further variant of an exemplary embodiment, with the cover 20 being a two-component plastic part. The first region 24 of the cover 20 serves as a pushbutton for the snap-action plate 40 in this case. The second region 25 of the cover 20 is formed with a mating latching element 21, with the mating latching element 21 being formed with a latching hook 21.1 at its free end. In the present exemplary embodiment, the cover 20 has two mating latching elements 21 with a latching hook 21.1 in each case, with each mating latching element 21 projecting through a latching element 13 of the base body 10. The latching element 13 of the base body 10 is in the form of an opening in which the mating latching element 21 of the cover 20 is held in a reliable manner.

This connection of the cover 20 to the base body 10 constitutes a reliable and simple latching connection. In this case, the second region 25 of the cover 20 is produced with the relatively hard second plastic, so as to ensure that the cover 20 is reliably fixed to the base body 10. In contrast, the first region 24 of the cover 20 is formed with the first plastic which is softer than the second plastic. As in the other exemplary embodiments according to FIG. 1 to FIG. 7 too, the first region 24 of the cover 20 serves as a pushbutton in order to correspondingly deform the snap-action plate 40 which is situated beneath said cover.

As can be clearly seen in FIG. 9, the second region 25 of the cover 20 has an edge 25.1 on the lower face 27 of the cover 20. This edge 25.1 has a sealing means 28 which is formed from the first plastic. In this case, the first region 24 is integrally connected to the sealing means 28. The first contact area 31 and the second contact area 32 are respectively a constituent part of a first contact element 31A and of a second contact element 32A. In this case, the first contact area 31 and the second contact area 32 are located in the receptacle 11 of the base body 10. The first contact element 31A and the second contact element 32A extend from the receptacle 11 and leave the cover 20 at the point which is provided with reference symbol 29. In a further alternative embodiment which is not explicitly illustrated, the two contact elements 31A and 32A can extend perpendicular to the plane of the drawing according to FIG. 8. In order to ensure the cover 20, which is formed from two components, has good haptics properties and a long service life, the first region 24 and the second region 25 are formed with a common contact area 24.2, 25.2 which has a staircase-like geometry.

It goes without saying that further embodiments of a snap-action plate 40 can be used in this invention, it being possible for said further embodiments to have three or more than four support elements 42. The idea of the invention likewise also covers the possibility of the receptacle 11 having a geometric shape which differs from the circular design which is shown in the exemplary embodiments. The arrangement of the first contact area 31 and of the second contact area 32 can also vary within the receptacle 11. In order to increase the service life of the switch, the first contact area 31 and the second contact area 32 and also the snap-action plate 40, in particular the curved region 41 and the support elements 42, can have a coating which, in particular, comprises at least Au and/or Ni and/or Ag and/or Sn.

It is likewise feasible for the cover 20 to be composed entirely of the soft plastic, like the first region 24, according to all the exemplary embodiments.

LIST OF REFERENCE SYMBOLS

10 Base body
11 Receptacle
12 Wall region
13 Latching element
14 Collar element
20 Cover
21 Mating latching element, opening
21.1 Latching hook
22 Foot element
23 Seal
23.1 First seal region
23.2 Second seal region
24 First region of the cover
24.2 Contact area
25 Second region of the cover
25.1 Edge
25.2 Contact area
26 Internal contact element
27 Lower face
28 Sealing means
29 Position, location, point
31 First contact area
31A First contact element
32 Second contact area
32A Second contact element
40 Snap-action plate
41 Curved region of the snap-action plate
42 Support element

What is claimed is:

1. A switch for a door, a flap or a door handle of a motor vehicle, having a base body (10) which has a receptacle (11), a first contact area (31) and a second contact area (32), which are provided in the receptacle (11), a snap-action plate (40) which is arranged in the receptacle (11) and has a curved region (41), which is situated above the first contact area (31), and at least three support elements (42), with at least one support element (42) making contact with the second contact area (32), with the curved region (41) undergoing elastic deformation by means of operation of the snap-action plate (40), so that an electrical connection between the two contact areas (31, 32) can be achieved and therefore a switching signal can be generated, with the second contact area (32), which is at a distance from the first contact area (31), extending at least in regions around the first contact area (31) within the receptacle (11) in such a way that at least one support element (42) touches the second contact area (32) in every possible position of the snap-action plate (40) within the receptacle (11).

2. The switch as claimed in claim 1, wherein the receptacle (11) is of circular, oval, square, rectangular or triangular design.

3. The switch as claimed in claim 1, wherein the first contact area (31) is arranged centrally in the receptacle (11) and/or the second contact area (32) extends along the edge region of the receptacle (11).

4. The switch as claimed in claim 1, wherein the snap-action plate (40) has n support elements (42), with each support element being oriented at an angle $\alpha=(360/n)°$ relative to the adjacent support element.

5. The switch as claimed in claim 4, wherein the second contact area (32) extends on a circular path, with the length L of the second contact area (32) being $L>\text{arc}(\alpha)\times r$, where r is the radius of the circular path.

6. The switch as claimed in claim 1, wherein the second contact area (32) is made up of individual contact areas which are spaced apart from one another.

7. The switch as claimed in claim 1, wherein the first contact area (31) and the second contact area (32) are composed of metal, in particular wherein the first contact area (31) and the second contact area (32) are coated with gold.

8. The switch as claimed in claim 1, wherein the receptacle (11) has an obliquely running wall region (12) which tapers in the direction of the snap-action plate (40).

9. The switch as claimed in claim 1, wherein a cover (20), which is composed of plastic and is attached to the base body (10), closes the receptacle (11) in a sealing manner, with, in particular, the cover (20) being attached to the base body (10) in an interlocking and/or force-fitting and/or cohesive manner.

10. The switch as claimed in claim 9, wherein the base body (10) has latching elements (13) which project into mating latching elements (21) of the cover (20).

11. The switch as claimed in claim 9, wherein the cover (20) has a foot element (22) which projects into the receptacle (11) and makes contact with the support elements (42), as a result of which the snap-action plate (40) can be reliably fixed.

12. The switch as claimed in claim 11, wherein the foot element (22) runs in an encircling manner, in particular wherein the foot element (22) is of annular design.

13. The switch as claimed in claim 9, wherein the cover (20) has a seal (23) which has a first seal region (23.1) and a second seal region (23.2), with the first seal region (23.1) being a radial seal and the second seal region (23.2) being an axial seal, with, in particular, the seal (23) being L-shaped in a cross-sectional view of the cover (20).

14. The switch as claimed in claim 13, wherein the receptacle (11) is surrounded by a collar element (14) of the base body (10), with the cover (20) resting on the collar element (14), with, in particular, the seal (23) making contact with the collar element (14).

15. The switch as claimed in claim 9, wherein the cover (20) is a two-component plastic part, with a first region (24) of the plastic part being produced from a first plastic and a second region (25) of the plastic part being produced from a second plastic, with the first plastic being softer than the second plastic.

16. The switch as claimed in claim 15, wherein the first region (24) of the cover (20) is formed with an internal contact element (26) which extends in the direction of the curved region (42) of the snap-action plate (40).

17. The switch as claimed in claim 15, wherein the second region (25) of the cover (20) surrounds the first region (24) of the cover (20), with the second region (25) of the cover (20) being attached to the base body (10).

18. The switch as claimed in claim 1, wherein the curved region (41) of the snap-action plate (40) and the support elements (42) have a coating, the coating comprising at least Au and/or Ni and/or Ag and/or Sn in particular.

19. The switch as claimed in claim 10, wherein the mating latching element (21) of the cover (20) is formed with a latching hook (21.1) which is held in the latching element (13) of the base body (10), with the latching element (13) of the base body (10) being in the form of an opening.

20. The switch as claimed in claim 15, wherein the second region (25) of the cover (20) has at least one mating latching element (21).

21. The switch as claimed in claim 15, wherein the second region (25) of the cover (20) has an edge (25.1) on the lower face (27) of the cover (20), with the edge (25.1) having a sealing means (28) which is formed from the first plastic, with, in particular, the first region (24) being integrally connected to the sealing means (28).

22. The switch as claimed in claim 1, wherein the first contact area (31) and the second contact area (32) are respectively a constituent part of a first contact element (31A) and of a second contact element (32A), with the first contact element (31A) and the second contact element (32A) extending out of the receptacle (11).

23. The switch as claimed in claim 15, wherein the first region (24) and the second region (25) have a common contact area (24.2, 25.2) which is formed, in particular, in a stepped and/or staircase-like manner.

* * * * *